US008490608B2

(12) United States Patent
DeVos et al.

(10) Patent No.: US 8,490,608 B2
(45) Date of Patent: Jul. 23, 2013

(54) HEAVY PARTICLE OIL SEPARATOR SPLASH SHIELD

(75) Inventors: Dale A. DeVos, Orland Park, IL (US); Michael B. Goetzke, Orland Park, IL (US)

(73) Assignee: Electro-motive Diesel Inc., LaGrange, IL (US)

( * ) Notice: Subject to any disclaimer, the term of this patent is extended or adjusted under 35 U.S.C. 154(b) by 107 days.

(21) Appl. No.: 13/184,917

(22) Filed: Jul. 18, 2011

(65) Prior Publication Data

US 2012/0017866 A1 Jan. 26, 2012

Related U.S. Application Data

(60) Provisional application No. 61/365,894, filed on Jul. 20, 2010.

(51) Int. Cl.
*F02B 25/06* (2006.01)

(52) U.S. Cl.
USPC ..... 123/572

(58) Field of Classification Search
USPC .. 123/572–574, 41.86, 196 A, 196 R; 55/461
See application file for complete search history.

(56) References Cited

U.S. PATENT DOCUMENTS

| | | | | |
|---|---|---|---|---|
| 4,272,371 | A | 6/1981 | Moses et al. | |
| 4,597,372 | A | 7/1986 | Furukawa | |
| 4,656,991 | A * | 4/1987 | Fukuo et al. | 123/572 |
| 6,152,119 | A * | 11/2000 | Hoshiba et al. | 123/572 |
| 6,199,543 | B1 | 3/2001 | Bedkowski | |
| 6,647,973 | B1 * | 11/2003 | Schueler et al. | 123/572 |
| 6,694,957 | B2 | 2/2004 | Schueler et al. | |
| 2004/0255919 | A1 | 12/2004 | Bedkowski | |
| 2005/0188944 | A1 | 9/2005 | Mahakul et al. | |
| 2005/0189663 | A1 | 9/2005 | Dollie et al. | |
| 2011/0283967 | A1 * | 11/2011 | DeVos et al. | 123/196 R |
| 2012/0006306 | A1 * | 1/2012 | Boehm et al. | 123/572 |

* cited by examiner

*Primary Examiner* — M. McMahon
(74) *Attorney, Agent, or Firm* — Finnegan, Henderson, Farabow, Garrett & Dunner LLP

(57) ABSTRACT

The present disclosure generally relates to a locomotive diesel engine and, more particularly, to a heavy particle oil separator splash shield. Specifically, provided is a system and method for reducing exhaust particulate emissions. The present shield prevents large oil droplets in close proximity to the oil separator from easily entering the element, thus preventing less saturation of the oil separator and increasing the efficiency of the oil separator. As a result, environmental pollution is reduced.

7 Claims, 11 Drawing Sheets

HEAVY PARTICLE OIL SEPARATOR SPLASH SHIELD

CROSS-REFERENCE TO RELATED APPLICATIONS

This application is a Nonprovisional Patent Application, which claims benefit to U.S. Provisional Application Ser. No. 61/365,894 entitled "Heavy Particle Oil Separator Splash Shield," filed Jul. 20, 2010, the complete disclosure thereof being incorporated herein by reference.

TECHNICAL FIELD

This disclosure relates to reduction in exhaust particulate emissions from a locomotive diesel engine, and specifically to a heavy particle oil separator splash shield.

BACKGROUND OF THE DISCLOSURE

The present disclosure relates to reduction in exhaust particulate emissions from a locomotive diesel engine, and specifically to a heavy particle oil separator splash shield.

Oil separators are designed to trap and recover small oil droplets and particulate matter from vapors emitted from engines. Specifically, the crankcase ventilation oil separator is used to prevent the build-up of combustible gases in the crankcase, by collecting oil and particulate matter from vapors.

Cam shaft drive gears and counterweights are generally located in close proximity to the passage leading to the oil separator. The cam shaft drive gears are lubricated through a system of oil passages within the crankcase and manifolds which mount or connect to the mounting shafts for the gears. Oil passing through the gears is splashed around and on to the gears to create the necessary lubrication between the mating gear teeth. This splashing causes heavy particle liquid oil droplets to enter directly into the passage to the oil separator from the crankcase. The purpose of the oil separator is to collect oil and particulate matter from vapors that pass through its element. Therefore, additional oil splashed into the separator from the cam shaft drive gears decreases the efficiency of the element of the oil separator, thus allowing more particulate matter to be released into the atmosphere.

Thus, it is an object of the present disclosure to provide a shield between the moving parts of the engine (including the cam shaft drive gears) and the oil separator filter to prevent heavy particulate oil droplets from saturating the oil separator. Specifically, the present shield minimizes heavy particle oil droplets in close proximity to the oil separator from entering the filter, thus preventing saturation of the oil separator element and increasing the efficiency of the oil separator. As a result, environmental pollution is reduced.

The following description is presented to enable one of ordinary skill in the art to make and use the disclosure and is provided in the context of a patent application and its requirements. Various modifications to the preferred embodiment and the generic principles and features described herein will be readily apparent to those skilled in the art. For instance, although described in the context of a two-stroke diesel engine, the present device may be employed in any diesel engine. Thus, the present disclosure is not intended to be limited to the embodiments shown, but is to be accorded the broadest scope consistent with the principles and features described herein.

SUMMARY

The present disclosure generally relates to a locomotive diesel engine and, more particularly, to a heavy particle oil separator splash shield. Specifically, provided is a system and method for reducing exhaust particulate emissions. The present shield minimizes heavy particle oil droplets from the cam shaft drive gears from entering the oil separator. As a result, the present shield minimizes saturation of the oil separator, thereby increasing the efficiency of the oil separator and reducing environmental pollution.

DETAILED DESCRIPTION OF THE PREFERRED EMBODIMENTS

The present disclosure relates to reduction in exhaust particulate emissions from a locomotive diesel engine, and specifically to a heavy particle oil separator splash shield. The oil splash shield reduces the amount of heavy particle oil splashed from a cam shaft drive gear into the oil separator, thereby reducing engine exhaust particulate matter emissions. Specifically, a splash shield is positioned between the moving parts of the engine (including a cam shaft drive gear) and the oil separator to prevent direct path flow of heavy droplets into the oil separator such that excess oil does not saturate the element of the oil separator.

Figure 1:
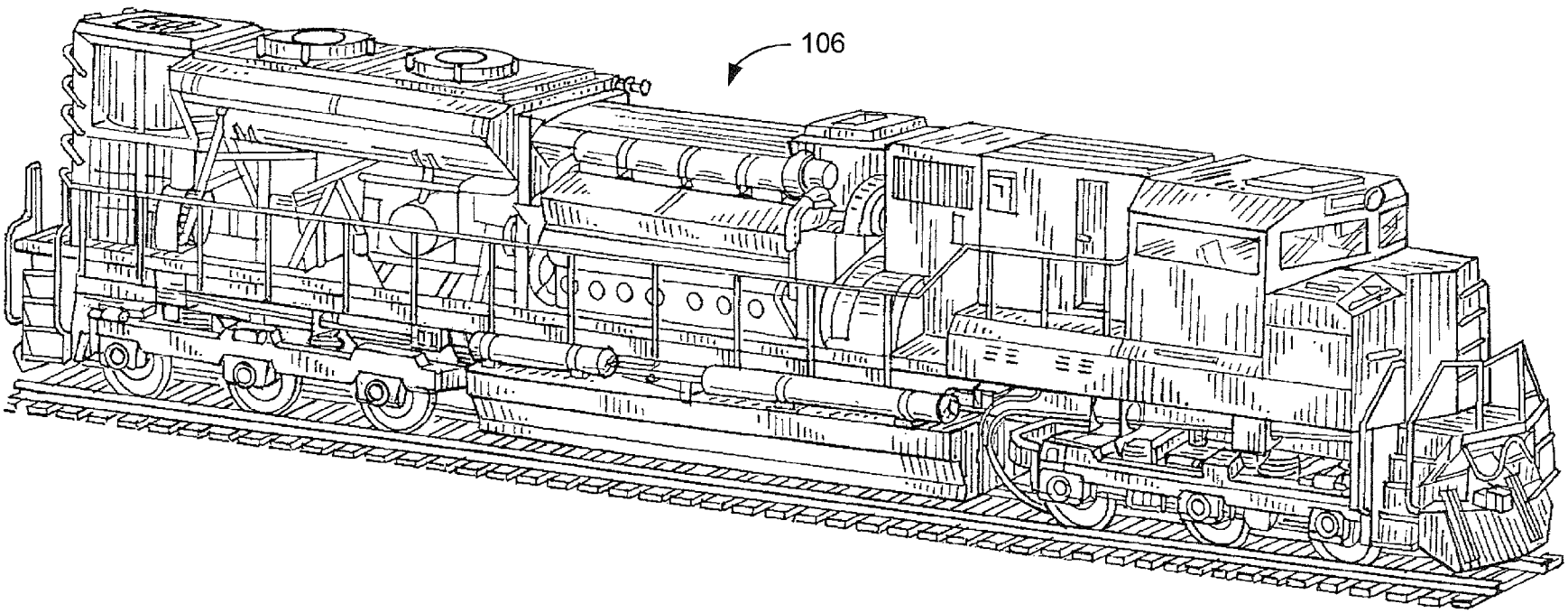
FIG. 1 is a perspective view of a locomotive.
Figure 2:
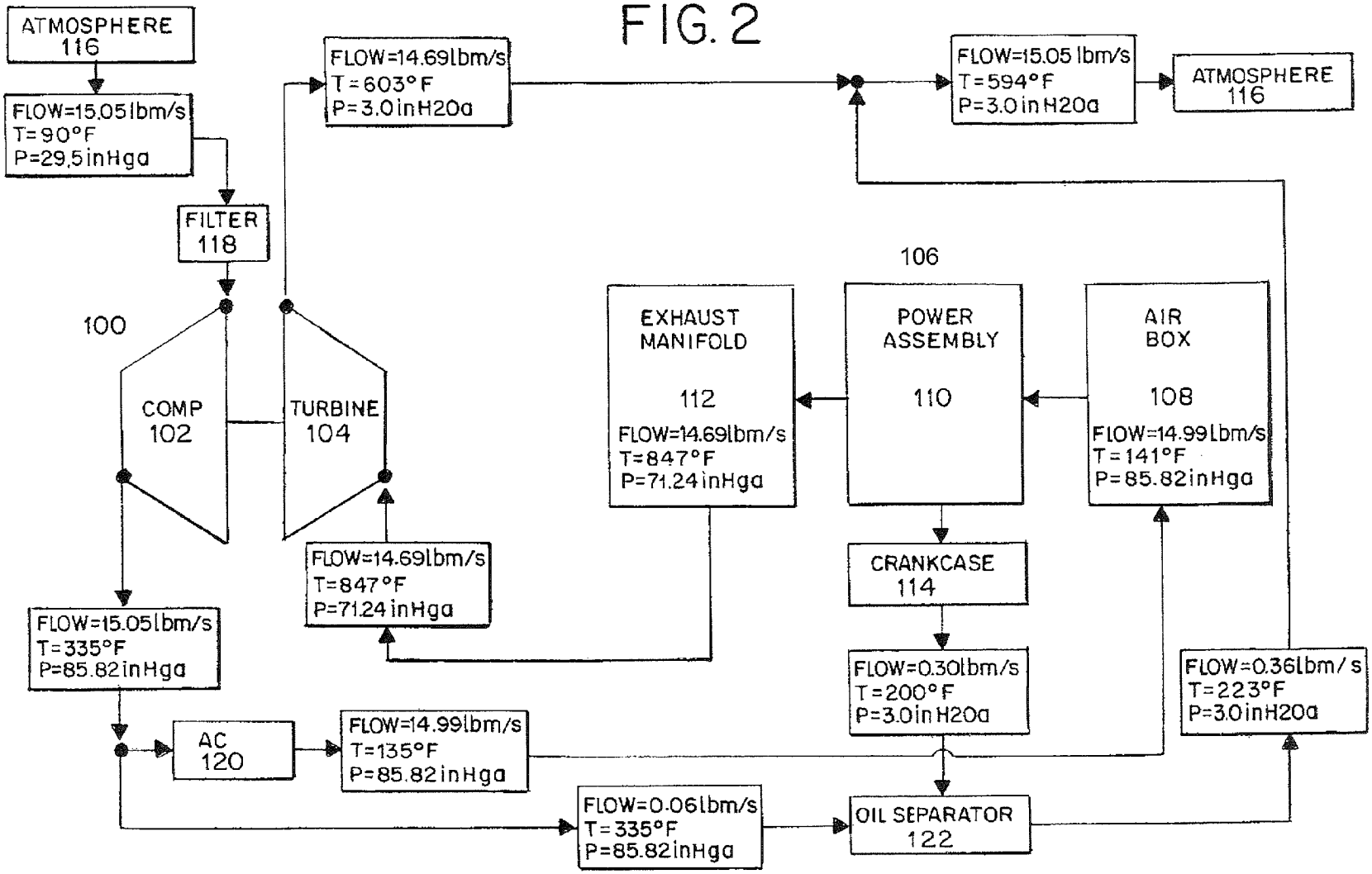
FIG. 2 is a system diagram of a locomotive diesel engine having a conventional air system.
Figure 3:
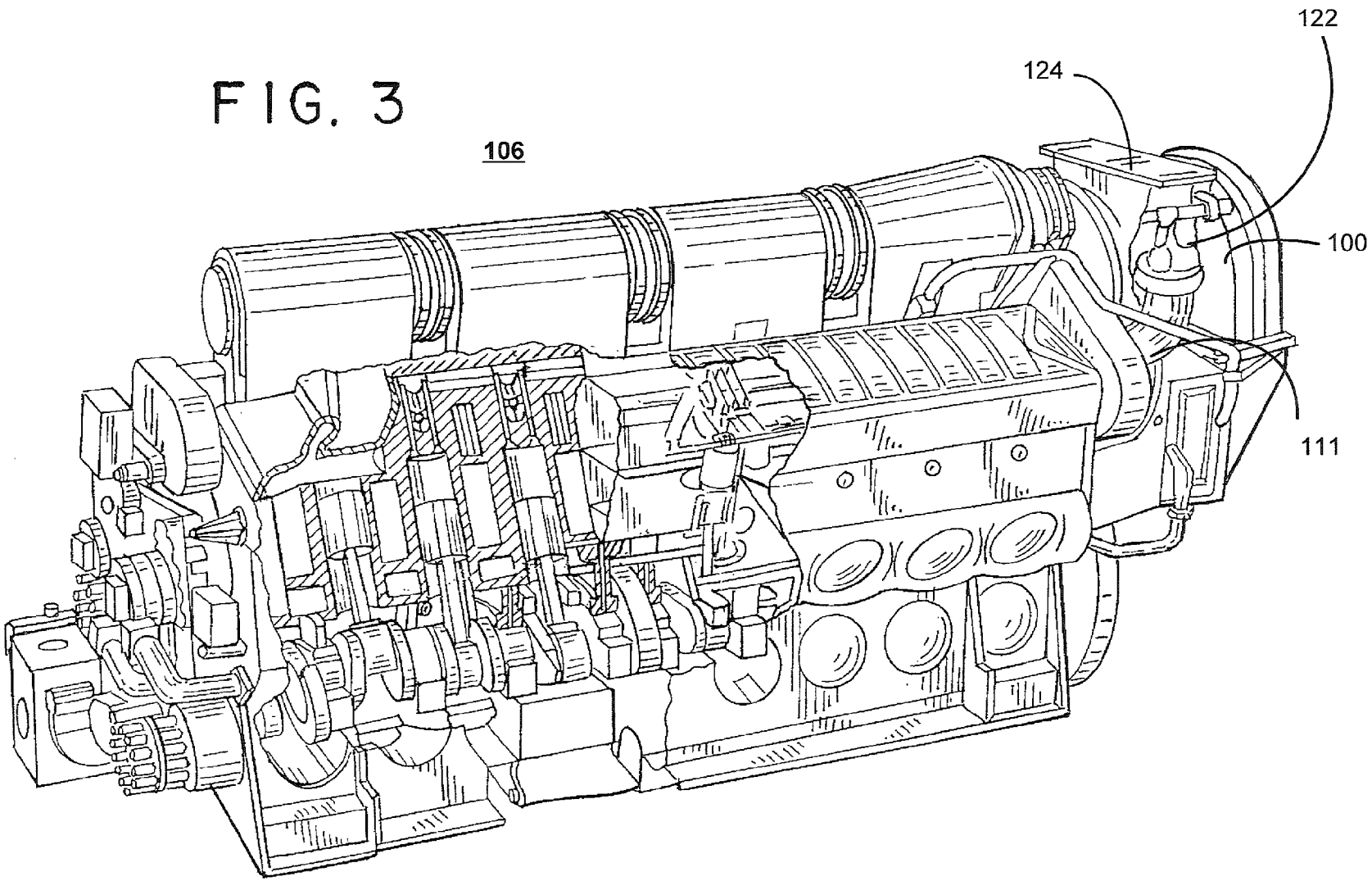
FIG. 3 is a partial cross-sectional view of a locomotive diesel engine.

FIGS. 1-3 illustrate the present locomotive diesel engine generally comprising a turbocharger 100 having a compressor 102 and a turbine 104 which provides compressed air to an engine 106 having an airbox 108, power assembly 110, an exhaust manifold 112, and a crankcase 114. In a typical locomotive diesel engine, the turbocharger 100 increases the power capability of the engine 106 by pressurizing and increasing the amount of air transferred to the engine 106. More specifically, the turbocharger 100 draws air from the atmosphere 116 which is filtered using a conventional air filter 118. The filtered air is pressurized by a compressor 102. The compressor 102 is powered by a turbine 104. A larger portion of the compressed air is transferred to an aftercooler 120 (or otherwise referred to as a heat exchanger, charge air cooler, or intercooler) where the compressed air is cooled to a select temperature. Another smaller portion of the compressed air is transferred to a crankcase ventilation oil separator 122 (or otherwise referred to as an oil separator or lube oil separator) which evacuates the crankcase 114 in the engine 106, entrains crankcase gas and filters entrained crankcase oil before release into the atmosphere 116.

Figure 4:
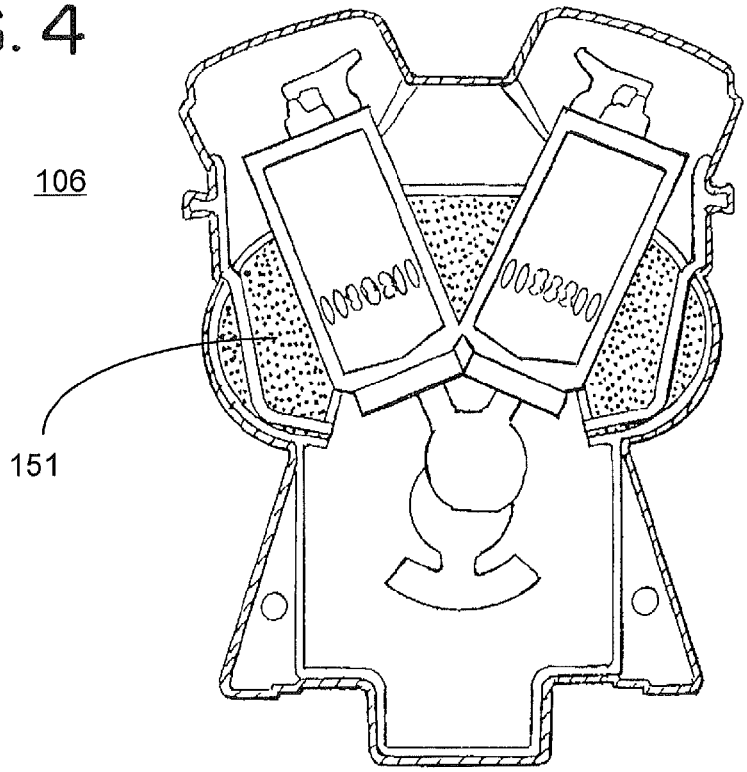
FIG. 4 is a cross-sectional view of a positive pressure zone of a diesel engine.
Figure 5:
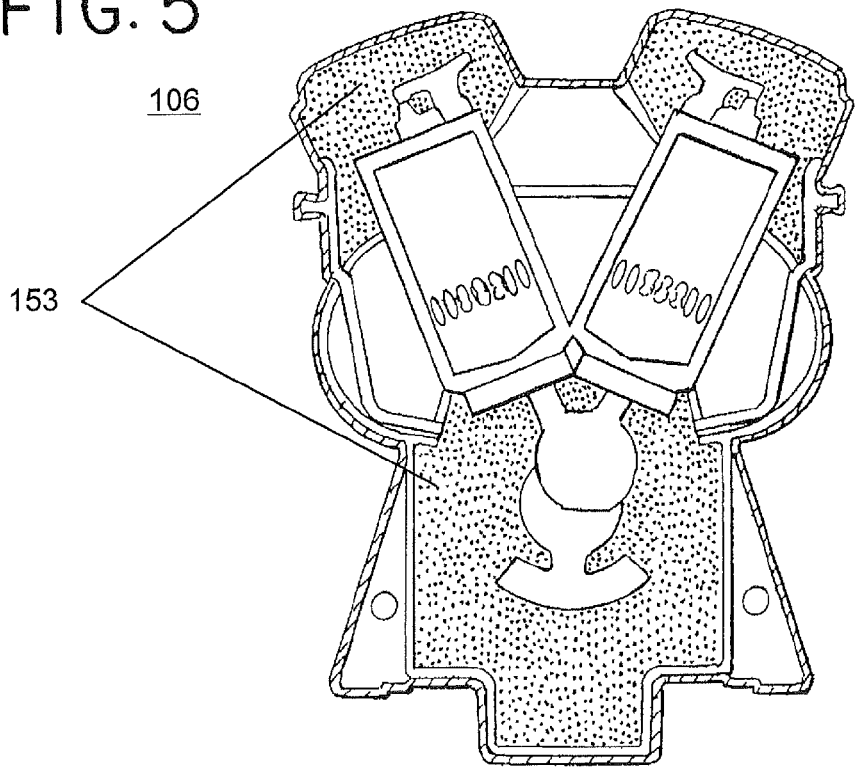
FIG. 5 is a cross-sectional view of a negative pressure zone of a diesel engine.

The engine 106 is divided into two distinct pressure zones: positive pressure 151 (above atmospheric pressure) and negative pressure 153 (below atmospheric pressure). The positive pressure zone 151 of a diesel engine 106 is illustrated in FIG. 4, whereas the negative pressure zone 153 of a diesel engine 106 is illustrated in FIG. 5. The engine 106 may include an eductor system to keep the crankcase 114 at a negative pressure whenever the engine is running. The top deck area of the engine is common to the engine sump through oil drain tubes, and the entire assembly is kept at negative pressure. Blower-equipped engines draw the crankcase 114 vapors through an oil separator 122 into the blower inlet. Turbocharger-equipped engines use an eductor (venturi) tube in the exhaust stack to draw the vapors through the oil separator 122 and expel them into the atmosphere.

Figure 6:
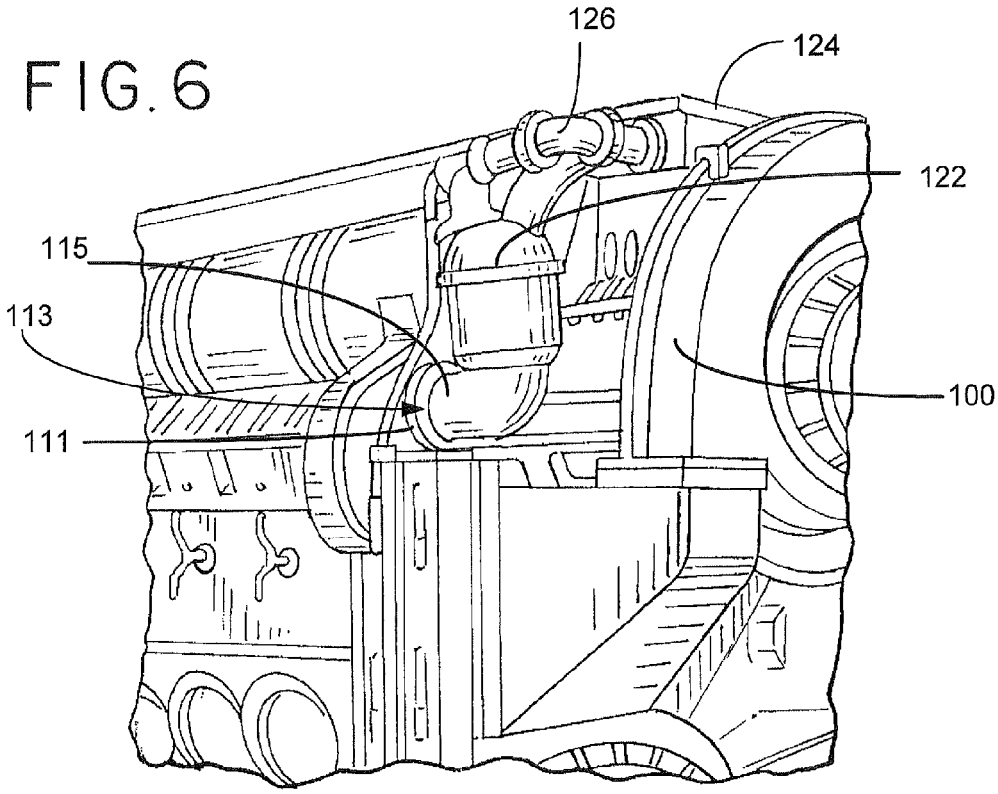
FIG. 6 is a partial perspective view of a locomotive diesel engine of FIG. 3.
Figure 7:
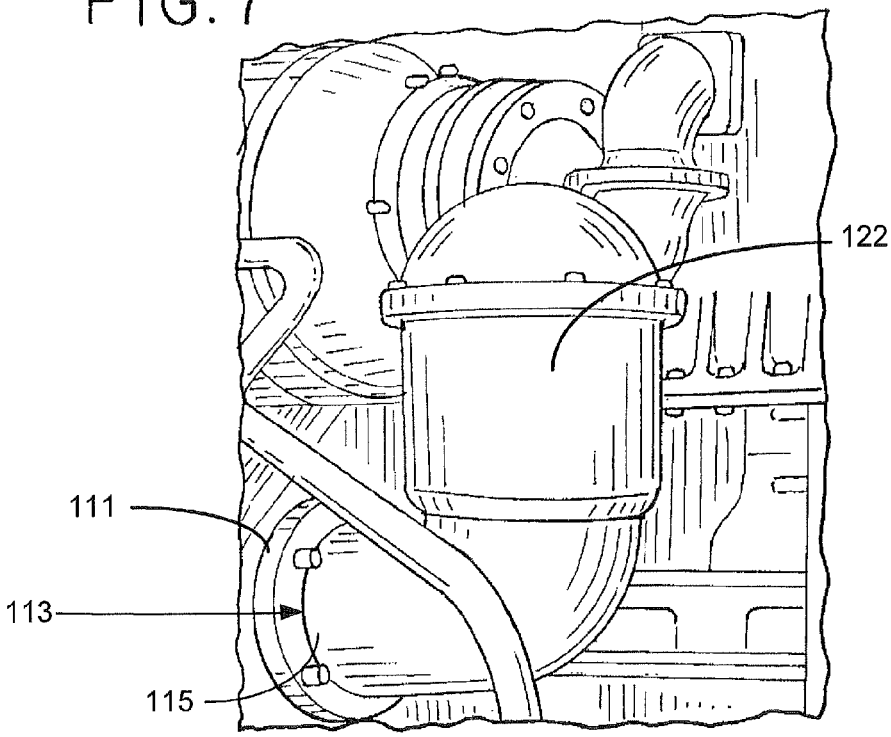
FIG. 7 is a perspective view of an oil separator assembly for a diesel engine.
Figure 8:
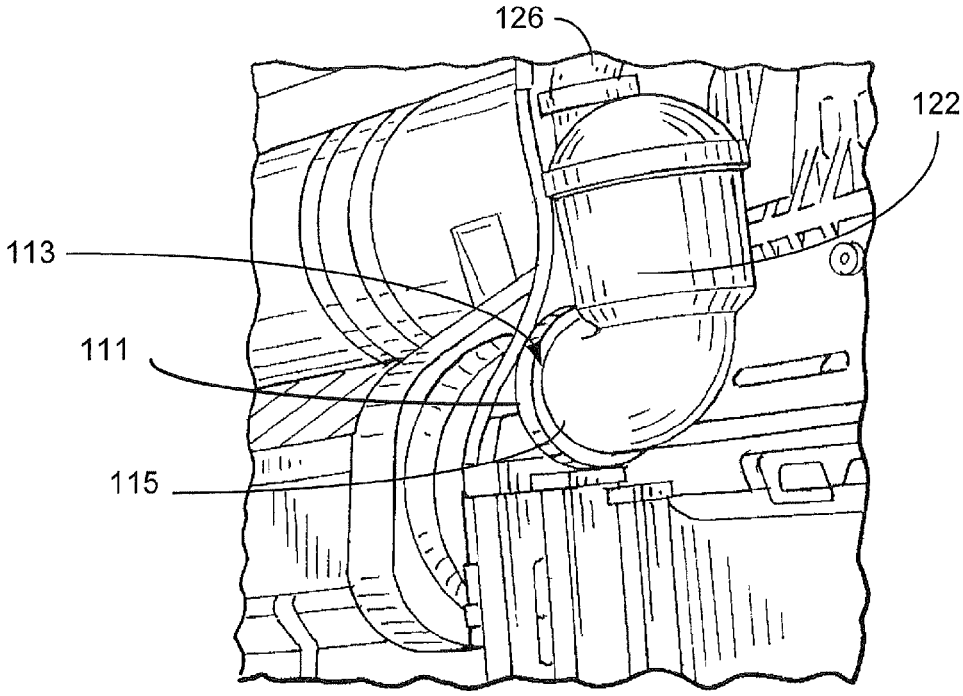
FIG. 8 is another perspective view of an oil separator assembly for a diesel engine.

The oil separator 122 is generally configured to trap and recover small oil droplets and particulate matter carried out through vapors from the crankcase. Specifically, the crankcase ventilation oil separator 122 is used to prevent the build-up of combustible gases in the crankcase 114, by collecting oil and particulate matter from the vapors that flow through it. As shown in FIGS. 6-8, in one embodiment, the oil separator 122 includes an elbow-shaped cylindrical housing containing a wire mesh screen element (not shown). However, any type of oil separator may be used. The oil separator 122 is mounted on the turbocharger mounting flange 111. The elbow assembly connects the oil separator 122 to the eductor tube assembly 126 in the exhaust stack 124. The eductor tube 126 in the exhaust stack 124 creates a suction which draws up vapor from the crankcase 114 through the separator element. The oil and particulate matter collects on the element and drains back to the crankcase 114. The remaining gaseous vapor, generally free of oil and particulate matter, is discharged into the exhaust and vented to the atmosphere.

Figure 9:
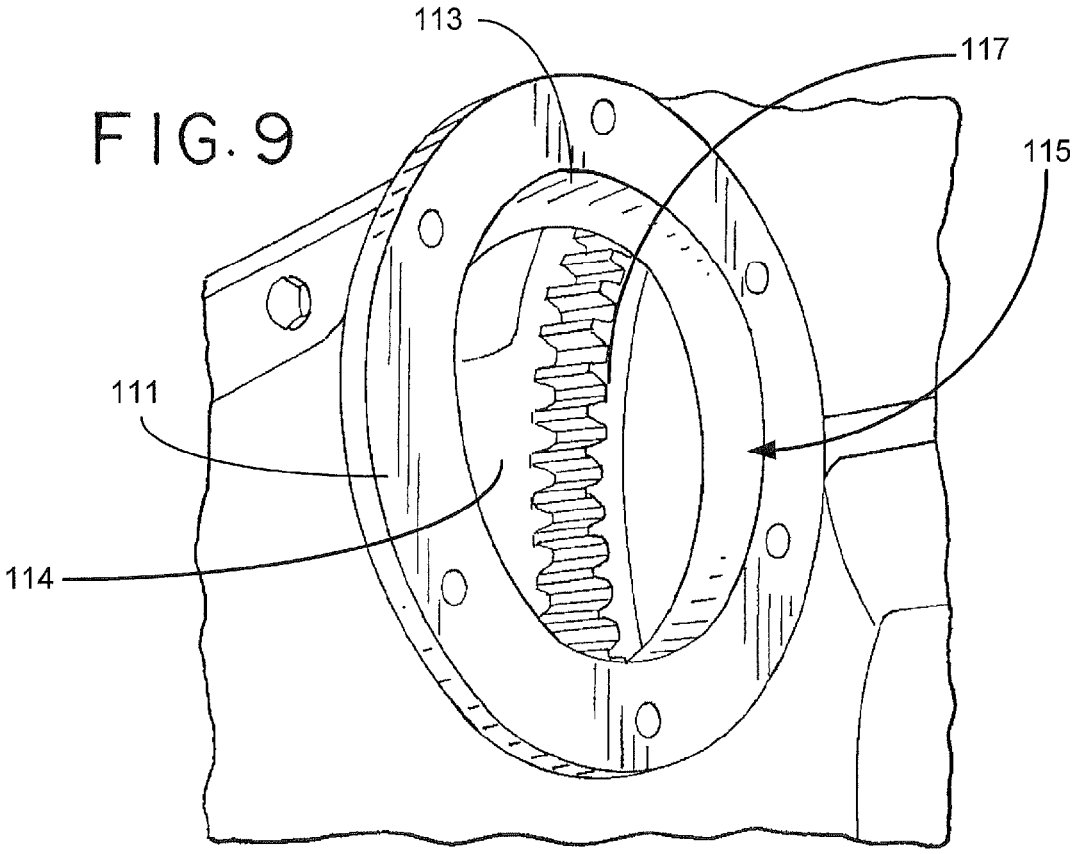
FIG. 9 is a perspective view of the opening defined in the mounting flange on turbocharger housing leading to the oil separator.
Figure 10:
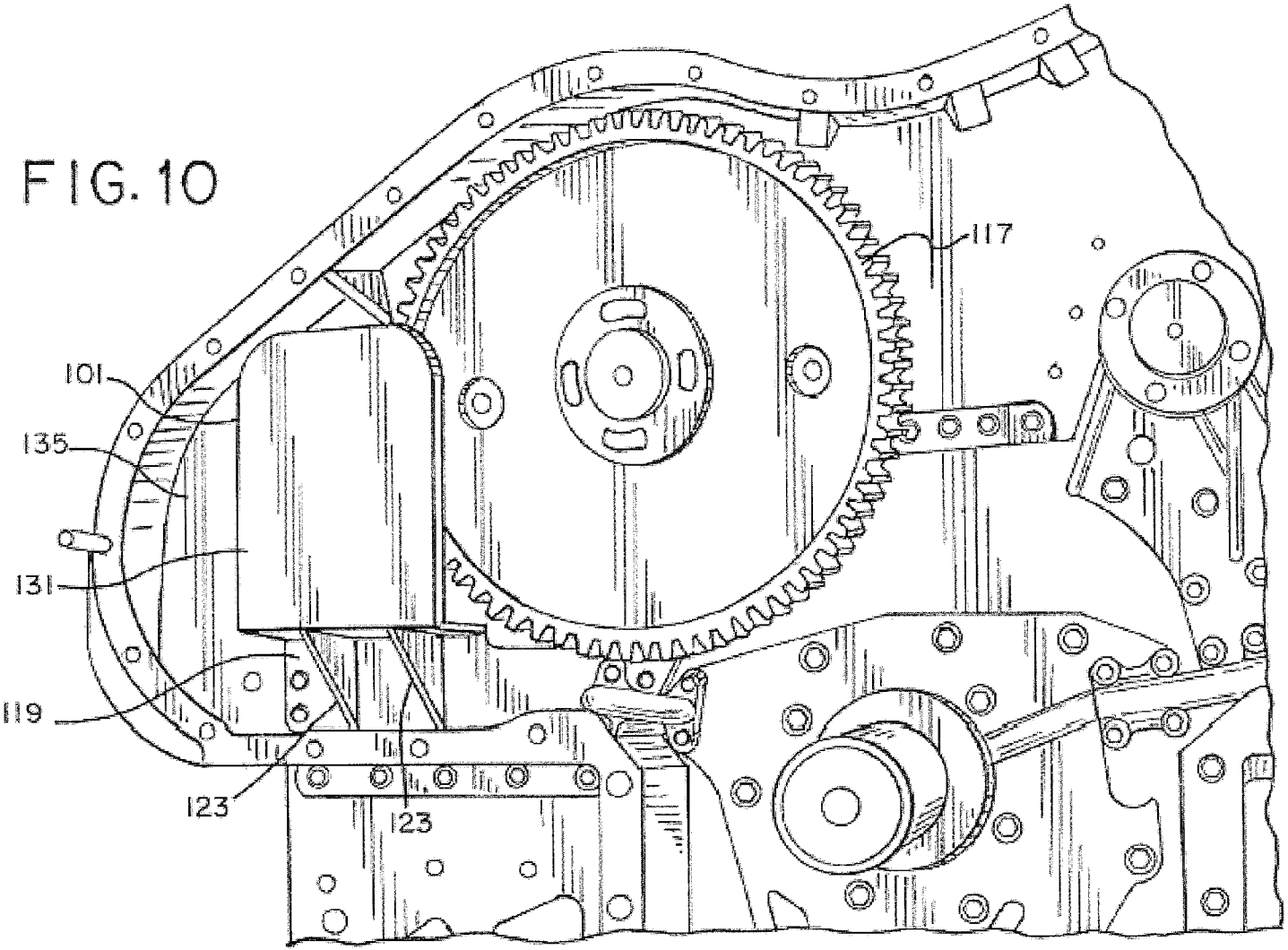
FIG. 10 is a perspective view of the mounting location of the present splash shield.
Figure 11A:
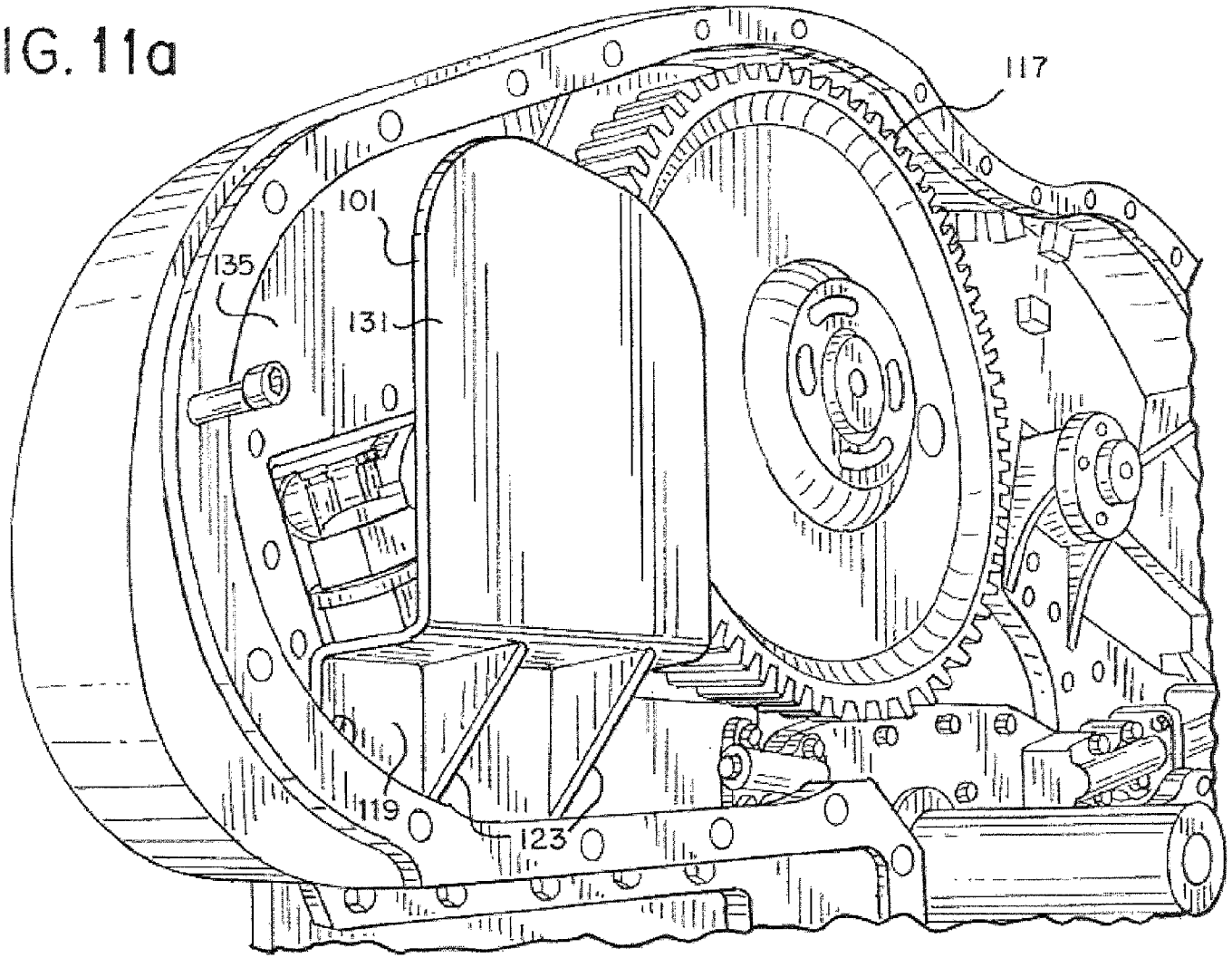
FIG. 11*a* is a side perspective view of the mounting location of the present splash shield of FIG. 10.
Figure 11B:
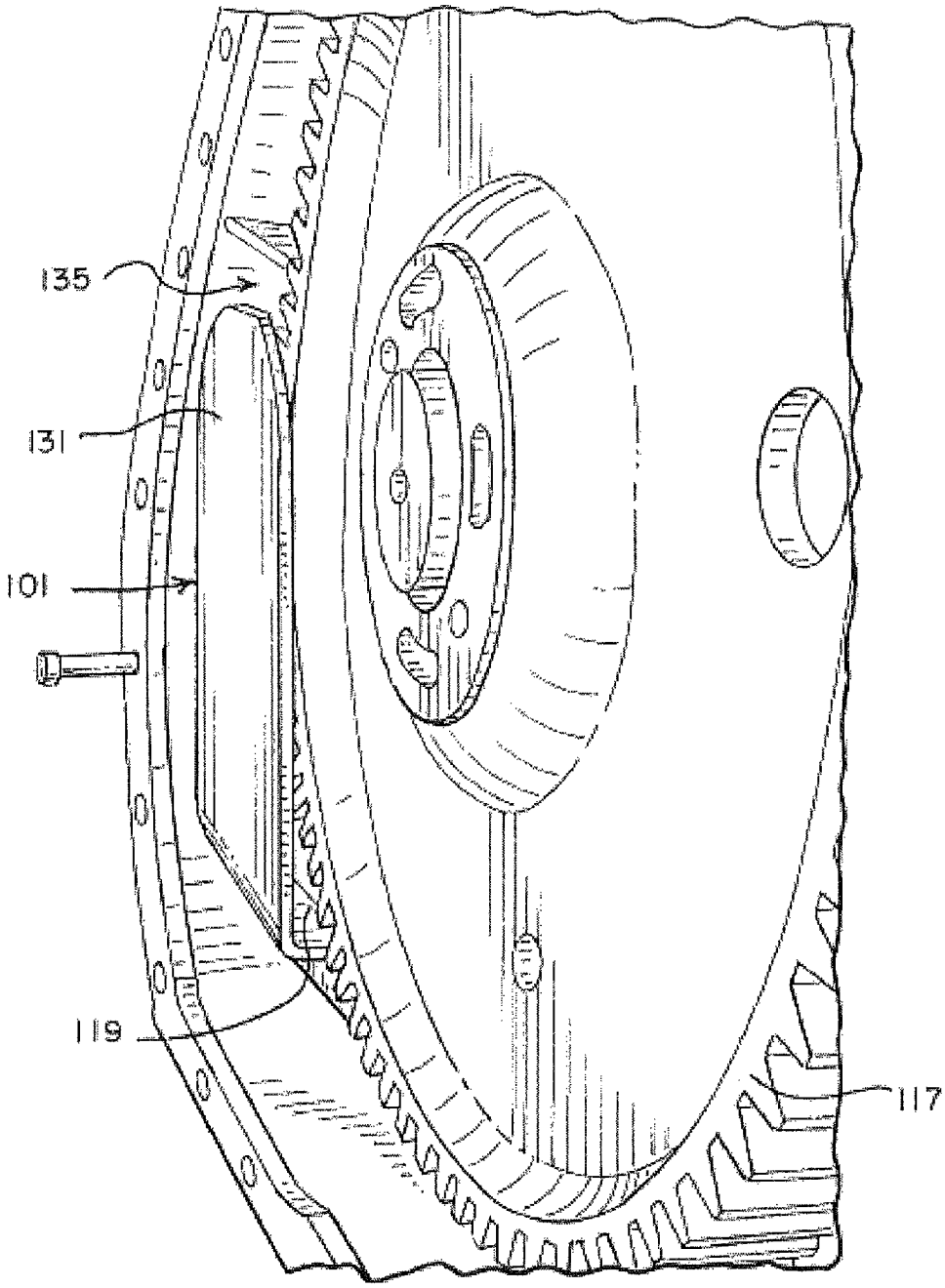
FIG. 11*b* is a side view of the mounting location of the present splash shield of FIG. 10.
Figure 11C:
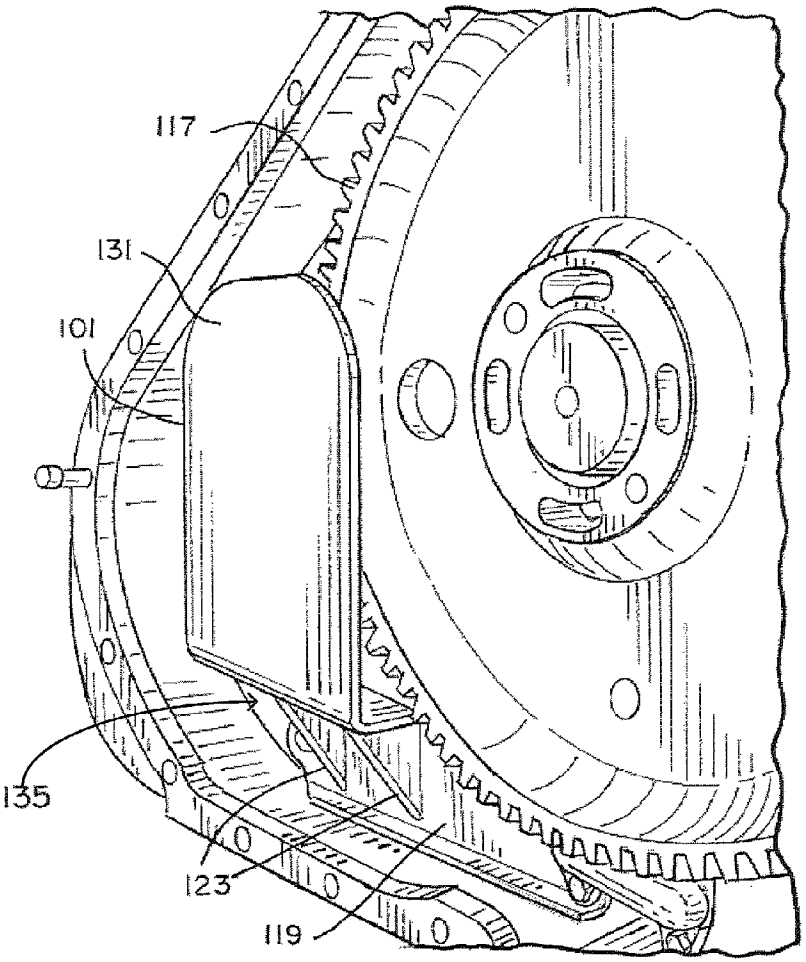
FIG. 11*c* is another side perspective view of the mounting location of the present splash shield of FIG. 10.
Figure 11D:
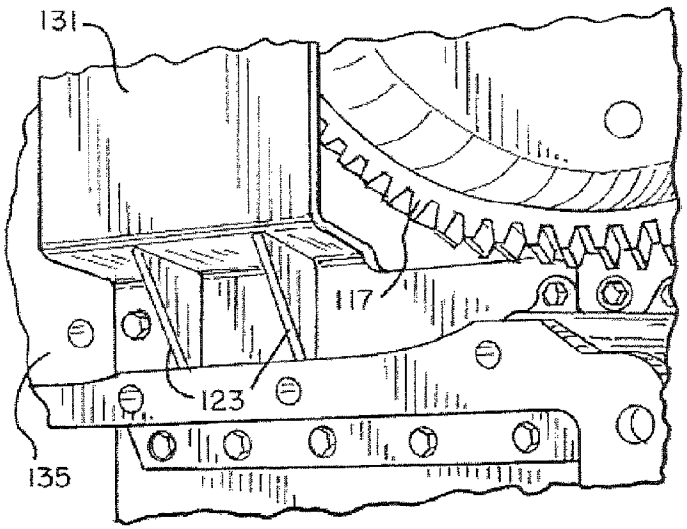
FIG. 11*d* is a detailed front side view of the mounting location of the present splash shield of FIG. 10.
Figure 13:
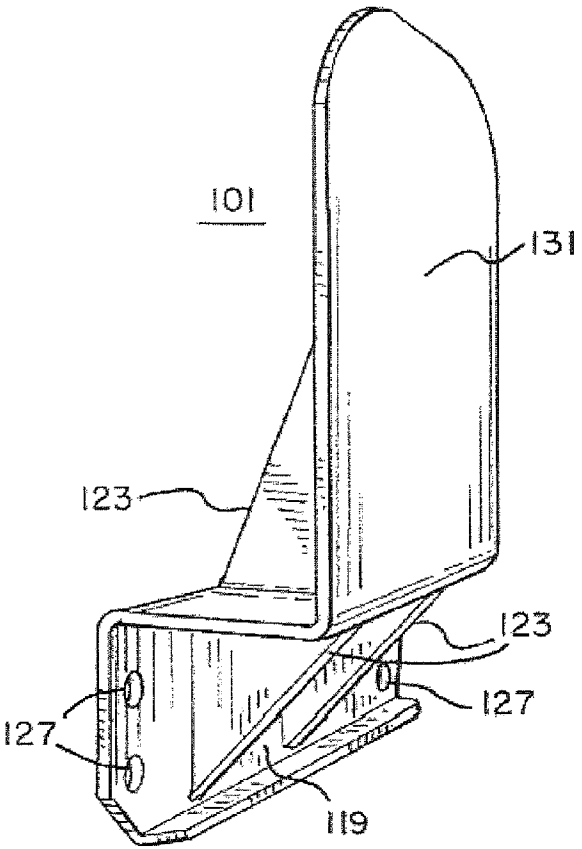
FIG. 13 is a side perspective view of an embodiment of the present splash shield.
Figure 12:
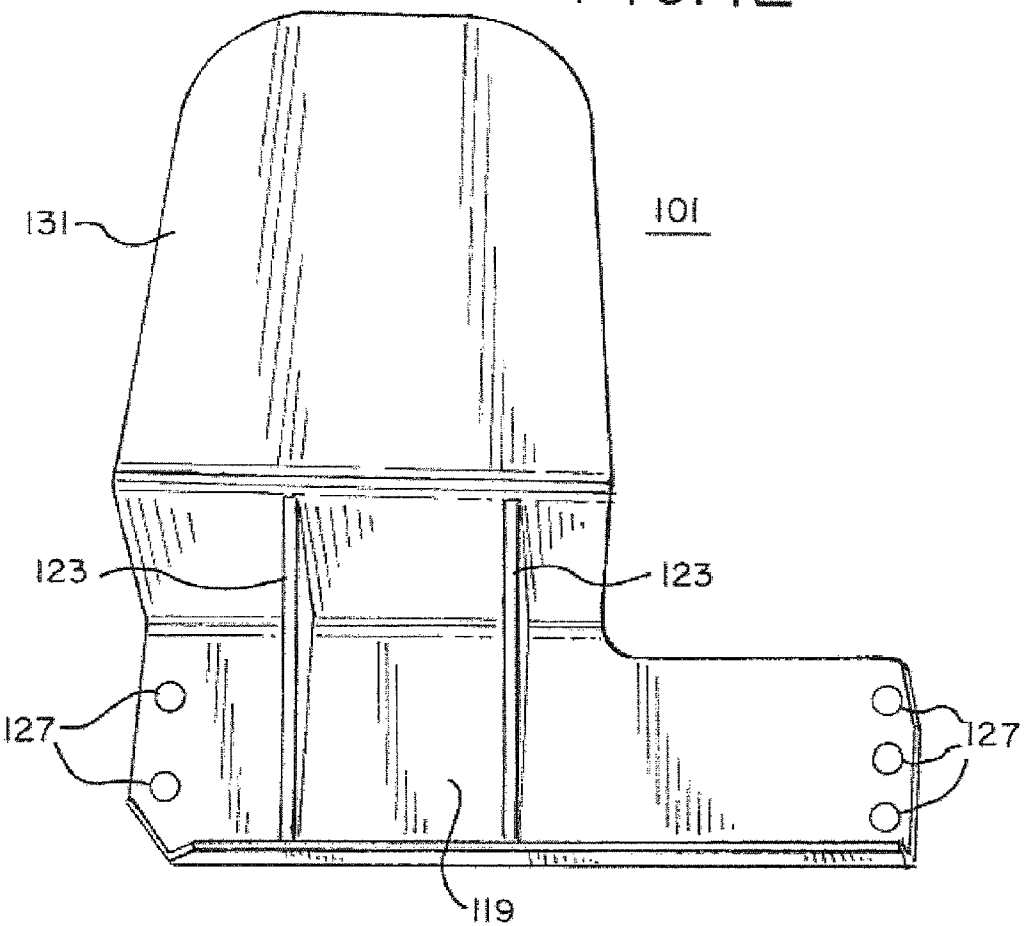
FIG. 12 is a front perspective view of an embodiment of the present splash shield.

As described above, and further illustrated in FIG. 9, cam shaft drive gears 117 and counterweights are generally located in close proximity to the passageway 115 leading to the oil separator 122. The cam shaft drive gears 117 are lubricated through a system of oil passages within the crankcase and manifolds which mount or connect to the mounting shafts for the gears. Oil passing through the gears 117 is splashed around and on to the gears 117 to create the necessary lubrication between the mating gear teeth. This splashing causes liquid oil droplets to enter directly into the connection joint or passageway 115 to the oil separator 122, which contaminate and saturate the element of the oil separator 122 more quickly and more heavily. The purpose of the oil separator 122 is to collect oil and particulate matter from vapors that pass through its element. Therefore, additional oil splashed into the separator from the cam shaft drive gears decreases the efficiency of the element of the oil separator 122, thus allowing more particulate matter to pass through with the vapors and into the atmosphere.

In the present system, an oil splash shield 101 is provided from minimizing transfer of heavy oil droplets from the cam shaft drive gears 117 to the oil separator 122 of the locomotive diesel engine (e.g., as shown in FIGS. 10-13). In this system, the engine 106 includes a passageway 115 for allowing vapor to flow from the crankcase 114 to the oil separator 122 for filtration. Specifically, vapor flows from the crankcase 114 to the passageway 115, via an opening 113 defined in the turbocharger mounting flange 111, and enters the oil separator 122. The oil splash shield 101 is situated adjacent to the mounting flange 111 leading to the oil separator 122, such that the shield deflects splashing heavy oil droplets from the cam shaft drive gears 117 away from the oil separator 122 and back onto the cam shaft gears 117. More specifically, the present shield 101 is situated adjacent to the opening 113 of the mounting flange 111 and is affixed to the housing 135 of the crankcase 114. This placement of the shield 101 generally prevents large oil droplets, splashed from the engine in close proximity to the oil separator 122, from contaminating and saturating the oil separator 122 element.

In one embodiment, as shown in FIGS. 10-13, the present shield 101 is comprised of a member 131 that is selectively sized and shaped such that it extends the near extends near a portion of the opening 113 (and preferably the entire area of the opening 113) of the mounting flange 111, which leads to the oil separator 122. Although shown in this embodiment to be a U-shaped plate with rounded edges, the member 131 may be any comparable shape. The present shield 101 further includes a mounting element 119 for affixing the shield 101 to the housing 135 of the crankcase. The mounting element 119 defines a plurality of apertures 127. Each aperture 127 may receive a fastening mechanism, such as a bolt, for affixing the shield to the housing 135 of the crankcase. The mounting element 119 is generally L-shaped and situated in relation to the member 131 to provide adequate support for the member 131. When the mounting element 119 is affixed to the housing 135, the member 131 is mounted such that it extends away from the crankcase 114 and gears 117, as illustrated in FIGS. 11*a*-11d.

Moreover, the member 131 is situated in relation to the moving parts of the engine (e.g., the cam shaft drive gears 117) such that it prevents flow of heavy particle oil droplets into the oil separator. Specifically, the member 131 is situated in the passageway between the crankcase 114 and oil separator 122 such that the shield 101 deflects splashing heavy oil droplets from the cam shaft drive gears 117 away from the oil separator 122. The member 131 is positioned such that it is set away from (that is, not flush with) the opening 113 of the mounting flange 111 leading to the oil separator 122. As a result, there is a clearance defined between the opening 113 of the mounting flange 111 and the shield 101. This clearance is sized and shaped such that vapor flow is maintained from the crankcase 114 to the oil separator 122 such that the efficiency of the oil separator 122 is not compromised by the presence of the shield 101. Thus, the member 131 prevents heavy particle oil droplets from saturating the element, while the larger aperture allows vapor to enter the oil separator 122. Because the oil separator 122 element is not oversaturated with extraneous heavy particle oil droplets from the cam shaft drive gear 117, it is able to more efficiently separate oil from the passing vapor. As a result, particulate emissions are reduced.

Additionally, the shield 101 may further include a plurality of support members 123 for maintaining the rigidity of the shield 101. In the embodiment shown in FIGS. 10-13, the support members 123 are in the form of support triangles; however, they may be any comparable shape. Specifically, the support members 123 maintain the L-shape of the mounting element 119 and secure the positioning of the member 131.

In applications that cause back pressure in the exhaust system, such as exhaust silencers or extended exhaust piping runs, an air ejector system is used to increase crankcase vacuum. In this system, pressurized air from the left bank aftercooler duct is piped to the ejector, where it blows through a venturi, adding to the suction created by the eductor tube. Different size ejector nozzles may be used to aid in maintaining proper crankcase suction levels. To increase crankcase suction, a large diameter nozzle is applied, after the engine is inspected for other causes of low vacuum. Oil droplets and particulate matter collect in the oil separator, and drain back to the crankcase, while the vapors discharge, generally free of oil and particulate matter, into the exhaust and are vented to the atmosphere.

The present disclosure has been described in accordance with the embodiments shown, and one of ordinary skill in the art will readily recognize that there could be variations to the embodiments, and any variations would be within the spirit and scope of the present disclosure. Accordingly, many modifications may be made by one of ordinary skill in the art without departing from the spirit and scope of the appended claims.

The invention claimed is:

1. An oil splash shield for minimizing transfer of heavy particle oil droplets from a cam shaft drive gear of a crankcase to an oil separator in a locomotive diesel engine, wherein the engine includes a turbocharger having a mounting flange defining an opening therein leading to the oil separator, wherein vapors flow from the crankcase to the oil separator via the opening, wherein the oil separator is configured to separate particulate matter and oil from the vapors emitted from the crankcase, wherein said crankcase includes a crankcase housing, said oil splash shield comprising:

a member situated adjacent to the opening between the oil separator and the crankcase of the engine, said member being selectively sized and shaped to extend near a portion of the opening to deflect heavy oil droplets, said member being positioned such that a clearance is defined between the member and the opening for allowing vapors to flow from the crankcase to the oil separator, and a mounting element for affixing the shield to the crankcase housing, wherein the mounting element is situated in relation to the member such that affixation of the mounting element to the crankcase housing causes the member to extend away from the crankcase and towards the opening.

2. The oil splash shield of claim 1 wherein the member is U-shaped with rounded edges.

3. The oil splash shield of claim 1 wherein the mounting element defines a plurality of apertures for receiving a fastening mechanism for affixing the shield to the crankcase housing.

4. The oil splash shield of claim 3 wherein the fastening mechanism is a bolt.

5. The oil splash shield of claim 1 wherein the mounting element forms an L-shape to provide support for the member.

6. The oil splash shield of claim 1, wherein the mounting element includes a plurality of support members for maintaining the rigidity of the shield.

7. The oil splash shield of claim 6 wherein the support members are in the form of support triangles.

* * * * *